US006029628A

United States Patent [19]

Oleksiewicz et al.

[11] Patent Number: 6,029,628

[45] Date of Patent: Feb. 29, 2000

[54] ELECTRIC-OPERATED FUEL INJECTION HAVING DE-COUPLED SUPPLY AND DRAIN PASSAGES TO AND FROM AN INTENSIFIER PISTON

[75] Inventors: Radek A. Oleksiewicz; Beata M. Oleksiewicz, both of Riverwoods, Ill.

[73] Assignee: Navistar International Transportation Corp., Chicago, Ill.

[21] Appl. No.: 09/074,358

[22] Filed: May 7, 1998

[51] Int. Cl.[7] ..... F02M 37/04

[52] U.S. Cl. ..... 123/446; 123/458

[58] Field of Search ..... 123/446, 458, 123/506, 499

[56] References Cited

U.S. PATENT DOCUMENTS

| | | | |
|---|---|---|---|
| 3,837,324 | 9/1974 | Links | 123/458 |
| 3,851,635 | 12/1974 | Murtin | 123/458 |
| 4,168,688 | 9/1979 | Bart | 123/458 |
| 4,401,076 | 8/1983 | Sano | 123/357 |
| 4,448,168 | 5/1984 | Komada | 123/458 |
| 4,619,239 | 10/1986 | Wallenfang | 123/458 |
| 5,460,329 | 10/1995 | Sturman . | |
| 5,479,901 | 1/1996 | Gibson et al. . | |
| 5,485,820 | 1/1996 | Iwaszkiewicz | 123/458 |
| 5,597,118 | 1/1997 | Carter, Jr. et al. . | |
| 5,669,355 | 9/1997 | Gibson | 123/446 |
| 5,687,693 | 11/1997 | Chen et al. . | |
| 5,722,373 | 3/1998 | Paul | 123/357 |

FOREIGN PATENT DOCUMENTS

WO 98/46876 10/1998 WIPO .

OTHER PUBLICATIONS

Navistar Brochure "HEUI Fuel System Operation", Brochure No. CGE 472–1, Navistar International Transportation Corp., Feb. 1995.

*Primary Examiner*—Carl S. Miller
*Attorney, Agent, or Firm*—Dennis Kelly Sullivan; Jeffrey P. Calfa

[57] ABSTRACT

A fuel injector for an internal combustion engine. The injector body contains a variable volume control chamber to and from which control fluid is supplied and drained to operate an intensifier piston which repetitively injects fuel from an injection chamber within the body. An electric-operated supply valve selectively controls flow of control fluid through a supply passage to the control chamber, and an electric-operated drain valve selectively controls flow of control fluid through a drain passage from the control chamber. Each valve is selectively operable independent of the other, and flow through the supply passage is independent of flow through the drain passage, and vice versa.

17 Claims, 3 Drawing Sheets

ELECTRIC-OPERATED FUEL INJECTION HAVING DE-COUPLED SUPPLY AND DRAIN PASSAGES TO AND FROM AN INTENSIFIER PISTON

FIELD OF THE INVENTION

This invention relates generally to internal combustion engine fuel systems, and more particularly it relates to electric-operated fuel injection systems and fuel injectors.

BACKGROUND OF THE INVENTION

An electric-operated fuel injector for a compression-ignition internal combustion engine may comprise an intensifier piston for creating a high pressure injection of fuel directly into an associated engine cylinder. An intensifier piston comprises a head of given end area exposed to a control fluid, oil for example, in a control chamber, and a plunger, or rod, of smaller end area exposed to liquid fuel in an injection chamber.

It is known to employ an electric-operated spool valve for controlling both the introduction of pressurized control fluid into the control chamber and the draining of control fluid from the control chamber. As control fluid is introduced under pressure through one portion of the spool valve into the control chamber, the intensifier piston is downstroked to cause fuel in the injection chamber to be injected under pressure from a nozzle of the fuel injector into an associated engine cylinder. The intensifier piston is effective to amplify the pressure of the control fluid by a factor equal to the ratio of the head end area to the plunger end area and cause the amplified pressure to be applied to liquid fuel in the injection chamber. As a result, fuel is injected into a combustion chamber at a pressure substantially greater than the pressure of the control fluid. After an injection, the spool valve is operated to allow oil to drain from the control chamber through another portion of the spool valve, and the intensifier piston is upstroked to re-charge the injection chamber with liquid fuel in preparation for the next injection.

Examples of fuel injectors having valves like those just described appear in U.S. Pat. Nos. 3,837,324; 5,460,329; 5,479,901; and 5,597,118.

It is believed that as those fuel injectors operate, there is some degree of interaction between the supplying of control fluid to, and the draining of control fluid from, the control chamber. In other words, it is believed that those patents do not contemplate a fuel injector for an engine, the fuel injector comprising a body, a variable volume injection chamber within the body, a fuel port at which fuel enters the body, a fuel passage for conveying fuel from the fuel port to the injection chamber, a fuel injection port at which fuel from the injection chamber is injected from the body, a variable volume control chamber, a control fluid supply port at which control fluid enters the body, a control fluid drain port at which control fluid drains from the body, a piston operatively relating the injection chamber and the control chamber such that the volume of the injection chamber varies inversely with the volume of the control chamber, a control fluid supply port at which control fluid enters the body, a supply passage for conveying control fluid from the supply port to the control chamber, an electric-operated supply valve comprising an electric supply valve actuator and a supply valve mechanism controlled by the electric supply valve actuator for selectively controlling flow of control fluid through the supply passage, and a drain passage for conveying control fluid from the control chamber to the drain port, an electric-operated drain valve comprising an electric drain valve actuator and a drain valve mechanism controlled by the electric drain valve actuator for selectively controlling flow of control fluid through the drain passage, each valve actuator being selectively operable independent of the other to selectively operate the respective valve mechanism independent of the other, and the supply and drain passages being mutually independent such that fluid flow through each is independent of fluid flow through the other.

SUMMARY OF THE INVENTION

Accordingly, one generic aspect of the present invention relates to a fuel injector for an engine, the fuel injector comprising a body, a variable volume injection chamber within the body, a fuel port at which fuel enters the body, a fuel passage for conveying fuel from the fuel port to the injection chamber, a fuel injection port at which fuel from the injection chamber is injected from the body, a variable volume control chamber, a control fluid supply port at which control fluid enters the body, a control fluid drain port at which control fluid drains from the body, a piston operatively relating the injection chamber and the control chamber such that the volume of the injection chamber varies inversely with the volume of the control chamber, a control fluid supply port at which control fluid enters the body, a supply passage for conveying control fluid from the supply port to the control chamber, an electric-operated supply valve comprising an electric supply valve actuator and a supply valve mechanism controlled by the electric supply valve actuator for selectively controlling flow of control fluid through the supply passage, and a drain passage for conveying control fluid from the control chamber to the drain port, an electric-operated drain valve comprising an electric drain valve actuator and a drain valve mechanism controlled by the electric drain valve actuator for selectively controlling flow of control fluid through the drain passage, each valve actuator being selectively operable independent of the other to selectively operate the respective valve mechanism independent of the other, and the supply and drain passages being mutually independent such that fluid flow through each is independent of fluid flow through the other.

Another generic aspect of the present invention relates to a fuel injector for an engine, the fuel injector comprising a body, a variable volume injection chamber within the body, a fuel port at which fuel enters the body, a fuel passage for conveying fuel from the fuel port to the injection chamber, a fuel injection port at which fuel from the injection chamber is injected from the body, a variable volume control chamber, a control fluid supply port at which control fluid enters the body, a control fluid drain port at which control fluid drains from the body, a piston operatively relating the injection chamber and the control chamber such that the volume of the injection chamber varies inversely with the volume of the control chamber, a control fluid supply port at which control fluid enters the body, a supply passage for conveying control fluid from the supply port to the control chamber, an electric-operated supply valve comprising an electric supply valve actuator and a supply valve mechanism controlled by the electric supply valve actuator for selectively controlling flow of control fluid through the supply passage, and a drain passage for conveying control fluid from the control chamber to the drain port, an electric-operated drain valve comprising an electric drain valve actuator and a drain valve mechanism controlled by the electric drain valve actuator for selectively controlling flow of control fluid through the drain passage, each valve mechanism comprising a fluid control element that is selectively positioned by the respective electric actuator along a respective axis that is parallel to the main longitudinal axis of the body.

Still another generic aspect of the present invention relates to a fuel injector for an internal combustion engine, the fuel injector comprising a body, a variable volume injection chamber within the body, a fuel port at which fuel enters the body, a fuel passage for conveying fuel from the fuel port to the injection chamber, a fuel injection port at which fuel from the injection chamber is injected from the body, a variable volume control chamber, a control fluid supply port at which control fluid enters the body, a control fluid drain port at which control fluid drains from the body, a piston operatively relating the injection chamber and the control chamber such that the volume of the injection chamber varies inversely with the volume of the control chamber, a control fluid supply port at which control fluid enters the body, a supply passage for conveying control fluid from the supply port to the control chamber, a drain passage for conveying control fluid from the control chamber to the drain port, and an electric-operated valve mechanism for selectively controlling flow of control fluid through the supply passage independent of flow through the drain passage and for selectively controlling flow of control fluid through the drain passage independent of flow through the supply passage.

Still another generic aspect of the present invention relates to a fuel injector for an internal combustion engine as disclosed herein, in combination with an operating system that operates the fuel injector in various ways to achieve various fuel injection patterns, including terminations of fuel injections.

A fuel injector contemplated by these aspects of the invention is believed to possess several important advantages.

By providing the disclosed organization and arrangement for supplying control fluid to, and draining control fluid from, a control chamber, and by providing mutually independent control of the respective flows through the supply and drain passages, the supplying of oil to the control chamber is de-coupled from the draining of oil from the control chamber. This is believed to endow a fuel injector with an additional degree of freedom for fuel injection control strategies. Such an additional degree of freedom enables fuel injection pulses to be shaped in what are believed to be various novel patterns. The ability to produce various fuel injection patterns is believed useful in tailoring an engine to comply with relevant specifications and requirements.

Because of the organization and arrangement of a valve mechanism associated with a variable volume control chamber and a return spring that acts on a portion of an intensifier piston exposed to fluid in the control chamber, the inventive fuel injector can terminate a fuel injection in a way that minimizes influence of opposing magnetic force. The inventive fuel injector can terminate a fuel injection by essentially exclusively utilizing the force of the return spring that acts on the intensifier piston. This may allow more accurate, and/or faster, control of injection termination to be attained. Such a capability is achieved through the recognition that acceleration of a mass on which both a spring force and an opposing magnetic force are acting will be maximized if the opposing magnetic force is reduced to zero; therefore, the time required for terminating a fuel injection can be minimized by relying exclusively on the return force of a return spring acting on an intensifier piston.

The inventive fuel injector can be fabricated from relatively non-complex component parts and possesses a geometric organization and arrangement of such parts that can promote more accurate and/or more cost-efficient manufacturing procedures, along with attendant benefits. These considerations may also promote the realization of desirable functional attributes for a fuel injector, including attributes already mentioned.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
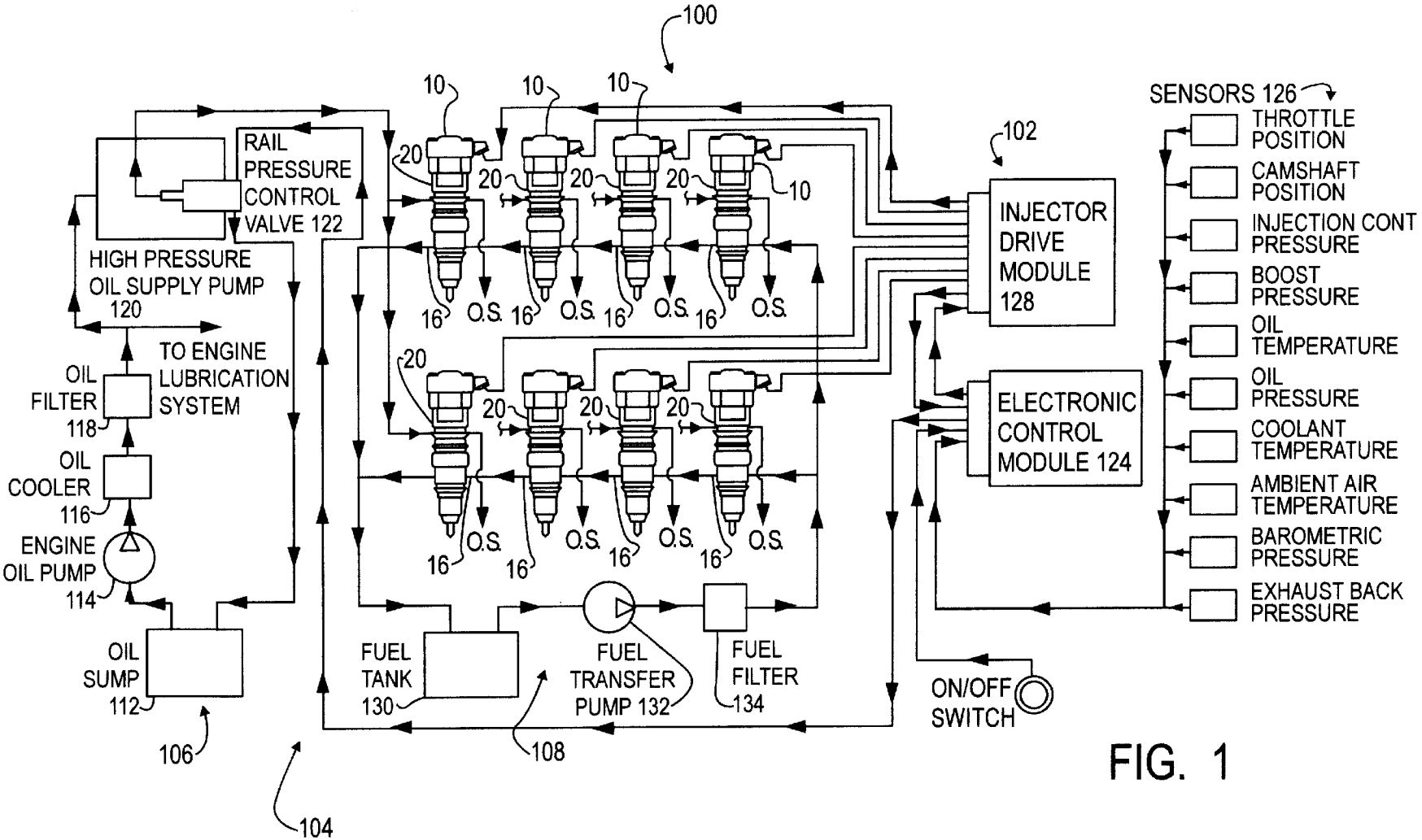
FIG. 1 is a general schematic diagram of a fuel injection system for a multi-cylinder, compression-ignition internal combustion engine containing fuel injectors embodying principles of the present invention.

FIG. 1 shows an exemplary fuel injection system 100 that has eight fuel injectors 10 each associated with a respective cylinder of a representative eight-cylinder, compression-ignition internal combustion engine that powers an automotive vehicle. System 100 includes an electronic control portion 102 and a fluid handling portion 104. The latter comprises two distinct fluid handling circuits associated with fuel injectors 10: a first fluid handling circuit, namely an engine oil circuit 106: and a second fluid handling circuit, namely a liquid fuel circuit 108.

In engine oil circuit 106, engine oil is drawn from a sump 112 by an engine oil pump 114 and pumped through an oil cooler 116 and an oil filter 118 to an inlet of a high pressure oil supply pump 120. Supply pump 120 is powered by the engine to pressurize the oil to a pressure within a range that may extend from about 450 psi to about 3,000 psi, by way of example. A rail pressure control valve 122 pressure-regulates oil that is pumped by pump 120 to a pressure determined by an electric current supplied to it by an engine control module (ECM) 124 that forms a part of electronic control portion 102. That current is developed through the use of algorithms embedded in ECM 124 to process selected input parameters, which may include parameters such as those received from certain sensors, collectively referenced at 126 in FIG. 1. The pressure-regulated oil is supplied to a pressure rail in a corresponding cylinder head of the engine so as to be constantly available at respective oil supply ports 20 of fuel injectors 10 in the respective rail. The engine shown herein as an example is a V-type having two such rails, each serving four engine cylinders.

Electronic control portion 102 further comprises an injector drive module (IDM) 128 operatively associated with ECM 124 and fuel injectors 10. ECM 124 supplies signals for selectively operating fuel injectors 10 in accordance with internally programmed algorithms processing certain parameters. When a particular fuel injector 10 is to be operated to inject fuel into its engine cylinder, ECM 124 signals IDM 128, and the latter in turn signals the corresponding fuel injector, causing an injection to occur. As will be more fully explained later, the signals which are supplied to fuel injectors 10 control certain characteristics of the fuel injections and recharging of the fuel injectors with liquid fuel between injections.

Fuel circuit 108 comprises a tank 130 for holding a supply of liquid fuel for the engine. A fuel transfer pump 132 draws fuel from tank 130 and pumps it through a fuel filter 134 and respective fuel rails that serve fuel injectors 10 in the respective cylinder heads to fuel supply ports 16 of fuel injectors 10. Fuel circuit 108 includes return passages for returning excess fuel from fuel injectors 10 to tank 130.

Figure 2:
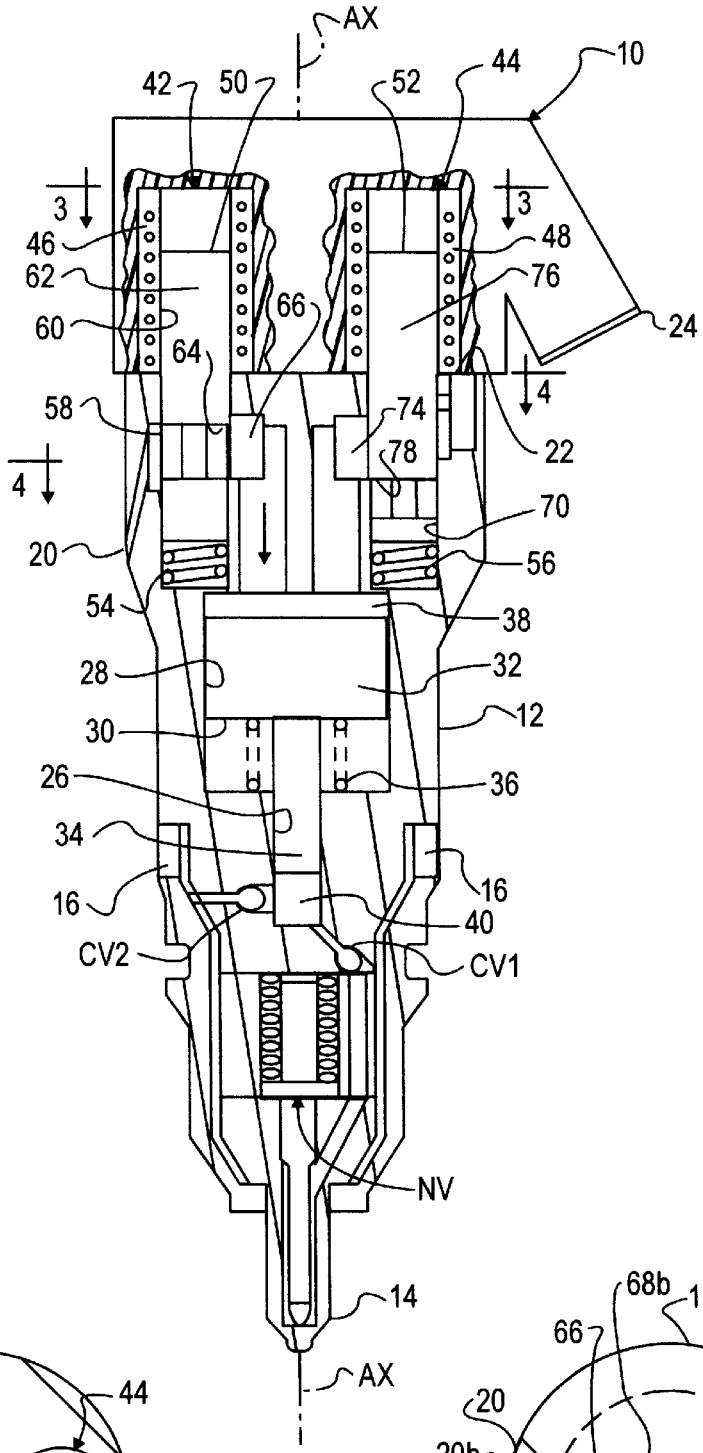
FIG. 2 is a somewhat schematic, longitudinal cross section view of a fuel injector embodying principles of the invention.
Figure 3:
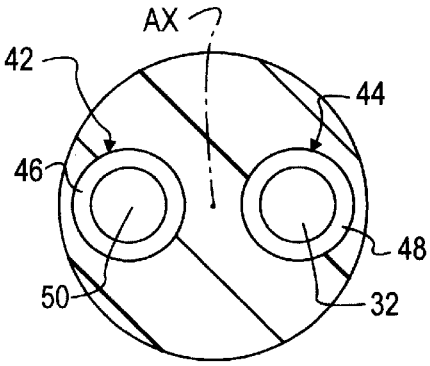
FIG. 3 is a full transverse cross section view in the direction of arrows 3—3 in FIG. 2.
Figure 4:
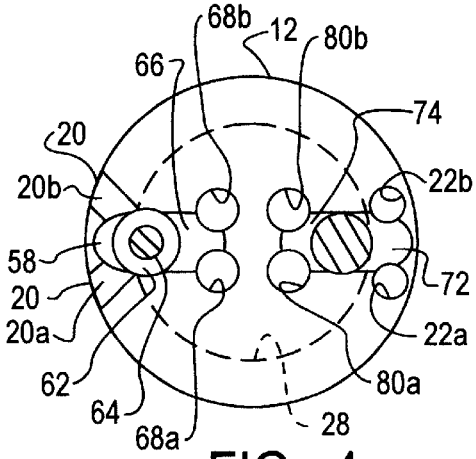
FIG. 4 is a full transverse cross section view in the direction of arrows 4—4 in FIG. 2.

FIGS. 2, 3, and 4 disclose a fuel injector 10 embodying principles of the present invention. Fuel injector 10 comprises a body 12 having an imaginary longitudinal axis AX and adapted for mounting on a multi-cylinder compression ignition internal combustion engine. Fuel injector 10 serves to inject fuel via an injection port comprising a nozzle 14 into a respective engine cylinder to form a fuel-air charge that, during a compression stroke of a piston that reciprocates within the cylinder, is compressed to the point of ignition proximate top dead center of the piston stroke, whereupon the ignition products downstroke the piston, driving an engine crankshaft to which the piston is coupled by a connecting rod.

Body 12 comprises three ports: fuel supply port 16 (mentioned above) through which pressurized liquid fuel is delivered to fuel injector 10; oil supply port 20 (also mentioned above) through which pressurized liquid oil is delivered to fuel injector 10; and an oil drain, or return, port 22 through which oil drains from fuel injector 10 back to oil sump 112. Fuel injector 10 further comprises an electric connector 24 that is externally accessible for mating with a complementary electric connector of a wiring harness (not shown in FIG. 2) to connect the fuel injector with IDM 128.

The interior of injector body 12 comprises a number of bores and passages. Coaxial with axis AX in an axially intermediate portion of body 12 is a circular cylindrical bore 26. A larger diameter circular cylindrical counterbore 28 that is also coaxial with axis AX is contiguous with bore 26 in a direction away from nozzle 14. An intensifier piston 30 comprises a circular head 32 guided for longitudinal displacement by a close sliding fit within counterbore 28. Piston 30 also comprises a circular cylindrical plunger, or rod, 34 extending from head 32 into bore 26 where it is guided for longitudinal displacement by a close sliding fit. A return spring 36 acts on piston 30 to bias it in a longitudinal direction away from nozzle 14.

Head 32 and counterbore 28 cooperatively define a variable volume chamber space 38, sometimes referred to herein as a control chamber, at one axial end of piston 30, and plunger 34 and bore 26 cooperatively define a variable volume chamber space 40, sometimes referred to herein as a fuel injection chamber, at the opposite axial end of piston 30. The organization and arrangement of control chamber 38, fuel injection chamber 40, and intensifier piston 30 are such that the volumes of the two chambers 38, 40 are inversely related by the longitudinal positioning of intensifier piston 30 along axis AX. In other words, as the volume of control chamber 38 increases, that of injection chamber 40 decreases, and vice versa. Piston 30 creates fluid pressure intensification, or amplification, because of the different surface areas of its opposite axial ends. For example, if the area of the piston head end is ten times as large as that of the plunger end, the amplification factor is ten.

Control chamber 38 is communicated to oil supply port 20 through an electric-operated supply valve 42 disposed in a supply passage and to oil drain port 22 through an electric-operated drain valve 44 disposed in a drain passage. The electric actuator of each valve 42, 44 comprises a respective solenoid 46, 48, and each valve further comprises a respective spool-type valve mechanism 50, 52, including a respective return spring 54, 56.

FIGS. 2 and 4 show oil supply port 20 to comprise two slant passages 20*a*, 20*b* extending in parallel flow relation to an undercut 58 disposed to one side of a circular cylindrical bore 60 in body 12. The bore axis is arranged parallel to axis AX, and a circular cylindrical valve spool 62 of valve mechanism 50 is disposed coaxially within bore 60. Spool 62 comprises a solid, nominally cylindrical shape that is interrupted at a particular location along its axis by a circular groove 64. When solenoid 46 is in an energized condition as depicted by FIG. 2, spool 62 is positioned axially within bore 60, compressing spring 54 in the process, to place groove 64 in axial registration with undercut 58. Disposed to a side of bore 60 opposite undercut 58 is another undercut 66. Two parallel passages 68*a*, 68*b* extend internally of body 12 from undercut 66 to control chamber 38. When solenoid 46 is in energized condition, groove 64 also axially registers with undercut 66. This represents the open condition of supply valve 42 during which oil can pass through the supply passage. When solenoid 46 is not in energized condition, spring 54 is allowed to relax and move groove 64 out of registration with undercuts 58, 66. This causes spool 62 to block flow between the two undercuts and close the supply passage.

Body 12 comprises another circular cylindrical bore 70 arranged parallel to, but spaced from, bore 60. The two bores 70, 60 are diametrically opposite each other about axis AX. Oil drain port 22 comprises two passages 22*a*, 22*b* extending in parallel flow relation to an undercut 72 disposed to one side of bore 70. Another undercut 74 is disposed to a side of bore 70 opposite undercut 72. A circular cylindrical valve spool 76 is disposed within bore 70, and it comprises a circular groove 78. Two parallel passages 80*a*, 80*b* extend internally of body 12 from undercut 74 to fluid control chamber 38. When solenoid 48 is in its energized condition shown by FIG. 2, it is positioning spool 76 such that spring 56 is compressed and groove 78 is out of axial registration with both undercuts 74, 72. Spool therefore blocks fluid flow between the two undercuts and hence blocks flow through the drain passage. When solenoid 48 is not energized, spring 56 is allowed to relax and move spool 76 such that groove 78 axially registers with undercuts 74, 72. This allows oil to drain from fluid control chamber 132, through drain valve 44, and back to oil sump 106, and represents the open condition of the drain passage.

FIG. 2 illustrates a condition that exists during an injection of liquid fuel from nozzle 14 into the associated engine cylinder: oil drain valve 44 is closed; oil supply valve 42 is open; and fuel injection chamber 40 is filled with liquid fuel. Oil flows under pressure through valve 42 and into control chamber 38. The oil pressure in control chamber 38 acts to move piston 30 in a direction that increases the volume of control chamber 38 and correspondingly reduces the volume of fuel injection chamber 40. Because of the difference between the areas of the opposite ends of piston 30, the pressure acting on the fuel in fuel injection chamber 40 is intensified. The intensified pressure unseats a check valve CV1 in a passage that extends from chamber 40 to nozzle 14, so that the intensified pressure fuel flows through that passage and is injected from nozzle 14 into the corresponding engine cylinder.

Fuel flow through the passage containing check valve CV1 may be stopped in two ways. One, by piston 30 abutting a stop, such as by the distal end of plunger 34 abutting the bottom end surface of bore 26; and two, by reducing the oil pressure in control chamber 38 to a pressure that is insufficient to continue increasing the control chamber volume. The latter will occur if oil pressure is lost at port 20, or if oil supply valve 42 closes, or if drain valve 44 opens. The loss of oil pressure at port 20 would typically occur only in the event of a malfunction, and so a control strategy for operating a fuel injector 10 will typically comprise controlling the opening and closing of valves 42, 44.

When both solenoids 46, 48 are not energized, supply valve 42 is closed and drain valve 44 is open. This represents an inactive state of fuel injector 10 where oil pressure is not being applied to oil in control chamber 38. The inactive state typically occurs between injections. Before an injection, fuel injection chamber 40 has been charged with an amount of liquid fuel sufficiently large to cover the fuel requirement for the injection. Re-charging of fuel injection chamber 40 may occur contemporaneous with opening of drain valve 44 after an injection to allow oil to drain from control chamber 38. Spring 36, which has been compressed by the previous downstroke of intensifier piston 30, is exerting on piston 30 a force acting to upstroke the piston. Because oil is now able to drain from control chamber 38 through the now-open drain valve 44, the return force of spring 36 upstrokes piston 30, forcing oil out of control chamber 38, through the drain passage, and back to oil sump 112. Concurrently, the pressure of liquid fuel at port 16 becomes effective to unseat a second check valve CV2 in a second passage associated with nozzle 14 in body 12, allowing liquid fuel to flow into the expanding volume of fuel injection chamber 40 and thereby replenish fuel injected during the previous injection. Intensifier piston 30 ultimately reposes at a position axially away from nozzle 14 that maximizes the volume of injection chamber 40 and minimizes that of control chamber 38. Attainment of such a position represents fuel injector 10 having been recharged in preparation for an ensuing fuel injection.

Having been recharged, fuel injector 10 may be operated in the following manner to inject fuel from nozzle 14. Drain valve 44 is operated closed, and then supply valve 42 is operated open. This allows pressurized oil to flow through supply valve 42 and into control chamber 38. The oil entering control chamber 38 downstrokes intensifier piston to force liquid fuel from injection chamber 40, through the passage containing check valve CV1, and out of the fuel injector through nozzle 14. FIG. 2 shows nozzle 14 to contain a pressure-responsive, spring-loaded needle valve NV for opening the nozzle when piston 30 is being downstroked and for otherwise closing the nozzle. Such a construction for nozzle 14 is known.

The inventive fuel injector 10 possesses a number of advantages. Because supply valve 42 is closed and drain valve 44 is open when their solenoids are not being energized, loss of electric power should not occasion fuel injection. Because valves 42, 44 control mutually independent flow passages to control chamber 38, and because the two valves are independently selectively operable, fuel injector 14 is endowed an ability to create various fuel injection patterns. Examples of fuel injection patterns that can be developed are shown in FIGS. 5–11.

Figure 5:
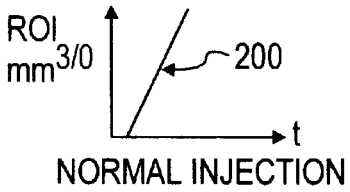
FIGS. 5–9 illustrate various graph plots related to various modes of fuel injector operation.

FIG. 5 illustrates what is referred to as "normal injection" represented by a graph plot 200 showing oil flow through supply valve 42 at a constant rate. This mode of fuel injection increases the volume of control chamber 38 at a constant rate, in turn downstroking piston 30 at a constant rate.

Figure 6:
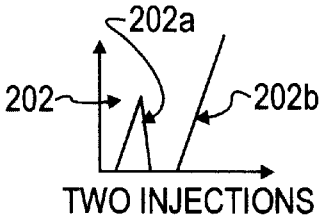

FIG. 6 illustrates what is referred to as "two injections" represented by a graph plot 202 composed of a pilot injection 202*a* followed by a regular injection 202*b*. Pilot injection 202*a* is created by opening supply valve 42 for a short time and then de-energizing solenoid 46 for a long enough time to arrest the flow of oil through it. At a time after the flow has been arrested, valve 42 is re-opened to create a regular injection.

Figure 7:
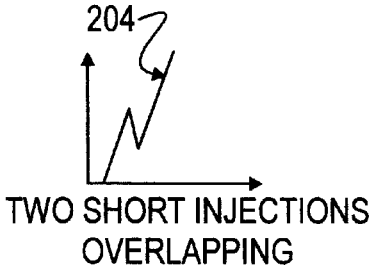

FIG. 7 illustrates what is referred to as "two short injections overlapping" represented by a graph plot 204. This injection pattern is created by opening supply valve 42 for a short time and then de-energizing solenoid 46, but only for a time that is insufficient to arrest the oil flow through the valve. Valve 42 is then re-opened to continue the injection.

Figure 8:
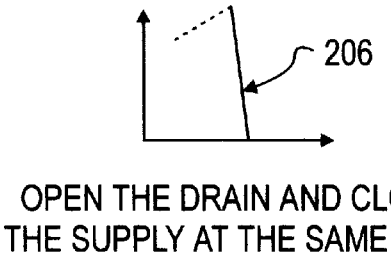
Figure 9:
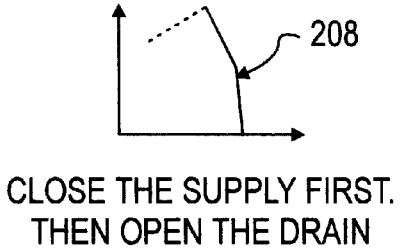

FIGS. 8 and 9 illustrate respective graph plots 206, 208 representing two different terminations for an injection. Graph plot 206 shows a termination that occurs when both solenoids 46, 48 are simultaneously de-energized. This mode of termination rapidly diminishes the flow of oil into control chamber 38. Graph plot 208 shows an injection termination in which solenoid 46 of supply valve 42 is de-energized slightly before solenoid 48 of drain valve 44 is. This produces an injection termination that is initially more gradual and subsequently, less gradual.

Figure 10:
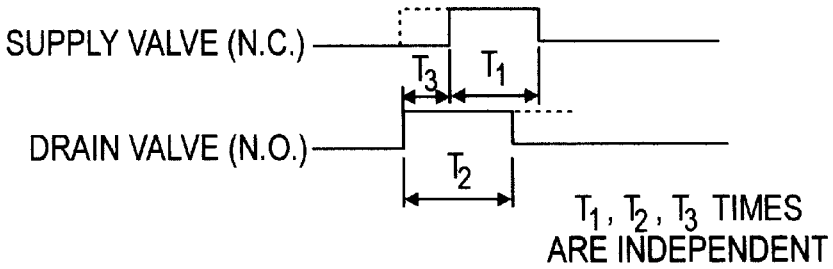
FIG. 10 is a graph plot of waveforms useful in explaining certain aspects of the invention.

By providing mutually independent supply and drain passages in association with control chamber 38, and by providing mutually independently operable valves 42, 44 for controlling flow through these two mutually independent passages, the supplying of oil to the control chamber is decoupled from the draining of oil from the control chamber. This may be considered as the introduction of an additional degree of freedom into the control of fuel injections, i.e. fuel injection control strategy. FIG. 10 is an explanatory diagram of this ability. The times marked $T_1$, $T_2$, and $T_3$ are independently controllable.

Figure 11:
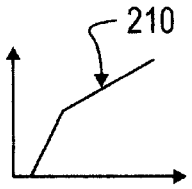
FIGS. 11 and 12 illustrate respective graph plots related to respective modes of fuel injector operation.
Figure 12:
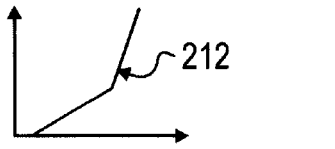

FIGS. 11 and 12 illustrate respective graph plots 210, 212 representing two different injection modes for a modified form of fuel injector 10. The modified form comprises a drain passage between control chamber 38 and drain port 22 that, when both valves 42, 44 are fully open, is relatively more restrictive than a supply passage between oil supply port 20 and control chamber 38. Graph plot 210 shows an injection mode that commences by operating supply valve 42 from closed to open while drain valve 44 is maintained closed. Subsequently, drain valve 44 is opened, and this has the effect of slowing, but not stopping, the fuel injection. Graph plot 212 shows an injection mode that commences by operating supply valve 42 from closed to open while drain valve 44 is maintained opened. Subsequently, drain valve 44 is operated closed. Initially, the injection proceeds at a certain flow rate, but when drain valve 44 closes, the injection rate increases. These modes may be considered rate-shaping injection modes, and they can take place even when a valve spool moves slowly, such as when battery voltage is low or oil is cold.

Fuel injector 10 also provides an advantageous capability for terminating an injection. By utilizing essentially exclusively the return force of spring 36, and not magnetic force, to terminate an injection, more accurate, and/or faster, control of such termination may be attainable. Such a capability is the result of the recognition that acceleration of a mass acted upon by both a spring force and an opposing magnetic force will be maximized if the opposing magnetic force is reduced to zero. Therefore, a fuel injection can be most quickly terminated by relying exclusively on the return force of spring 36. When drain valve 44 is opened, the force acting on piston 30 is essentially exclusively that of spring 36. Acceleration of piston 30 in the upstroke direction is thereby maximized, the piston being free of magnetic influences.

Still another aspect of fuel injector 10 resides in its use of relatively non-complex component parts, their geometries, and their geometric organization and arrangement in body 12. Spool valves and solenoids, such as valves 42, 44 and solenoids 46, 48, and intensifier piston 30, fall within the category of relatively non-complex component parts. Manufacturing tolerances for such parts can be well-controlled. Standardized sizes may be used, thereby saving on cost of goods. Electric circuit components associated with electronic control portion 102 may be economically selected. They include basic electronic driver modules of IDM 128 for driving the fuel injectors, and sensors for sensing electric current to the fuel injectors.

While a presently preferred embodiment of the invention has been illustrated and described, it should be appreciated that principles of the invention apply to all embodiments falling within the scope of the following claims.

What is claimed is:

1. A fuel injector for an internal combustion engine, the fuel injector comprising a body, a variable volume injection chamber within the body, a fuel port at which fuel enters the body, a fuel passage for conveying fuel from the fuel port to the injection chamber, a fuel injection port at which fuel from the injection chamber is injected from the body, a variable volume control chamber, a control fluid supply port at which control fluid enters the body, a control fluid drain port at which control fluid drains from the body, a piston operatively relating the injection chamber and the control chamber such that the volume of the injection chamber varies inversely with the volume of the control chamber, a supply passage for conveying control fluid from the supply port to the control chamber, an electric-operated supply valve comprising an electric supply valve actuator and a supply valve mechanism controlled by the electric supply valve actuator for selectively controlling flow of control fluid through the supply passage, and a drain passage for conveying control fluid from the control chamber to the drain port, an electric-operated drain valve comprising an electric drain valve actuator and a drain valve mechanism controlled by the electric drain valve actuator for selectively controlling flow of control fluid through the drain passage, each valve actuator being selectively operable independent of the other to selectively operate the respective valve mechanism independent of the other, and the supply and drain passages being mutually independent such that fluid flow through each is independent of fluid flow through the other, and in which the supply valve closes the supply passage to flow when the electric supply valve actuator is not electrically energized by electric current, and the drain valve opens the drain passage to flow when the electric drain valve actuator is not energized by electric current.

2. A fuel injector as set forth in claim 1 in which each actuator comprises a respective solenoid, and each valve mechanism comprises a respective grooved spool operated by the respective solenoid.

3. A fuel injector as set forth in claim 2 in which the body comprises a main longitudinal axis, and each grooved spool is positioned by the respective actuator along a respective axis that is parallel to the main longitudinal axis.

4. A fuel injector as set forth in claim 3 in which the piston comprises a head having an end surface exposed to the control chamber and a plunger having an end surface exposed to the injection chamber.

5. A fuel injector as set forth in claim 4 including a return spring acting on the piston in a direction along the main longitudinal axis toward minimizing the volume of the control chamber.

6. A fuel injector as set forth in claim 1 in which the supply valve mechanism comprises a grooved spool that is operated against the force of a return spring to open the supply passage when the electric supply valve actuator is energized by electric current, and the drain valve mechanism comprises a grooved spool that is operated against the force of a return spring to close the drain passage when the electric drain valve actuator is energized by electric current.

7. A fuel injector as set forth in claim 6 in which the body comprises a main longitudinal axis, and each grooved spool has an axis which is arranged parallel to the main longitudinal axis of the body and along which the respective spool is operated by the respective electric actuator.

8. A fuel injector as set forth in claim 1 in which the piston comprises a head having an end surface exposed to the control chamber and a plunger having an end surf ace exposed to the injection chamber, and including a return spring acting on the piston in a direction along the main longitudinal axis of the body in a direction toward minimizing the volume of the control chamber.

9. A fuel injector for an internal combustion engine, the fuel injector comprising a body, a variable volume injection chamber within the body, a fuel port at which fuel enters the body, a fuel passage for conveying fuel from the fuel port to the injection chamber, a fuel injection port at which fuel from the injection chamber is injected from the body, a variable volume control chamber, a control fluid supply port at which control fluid enters the body, a control fluid drain port at which control fluid drains from the body, a piston operatively relating the injection chamber and the control chamber such that the volume of the injection chamber varies inversely with the volume of the control chamber, a supply passage for conveying control fluid from the supply port to the control chamber, an electric-operated supply valve comprising an electric supply valve actuator and a supply valve mechanism controlled by the electric supply valve actuator for selectively controlling flow of control fluid through the supply passage, and a drain passage for conveying control fluid from the control chamber to the drain port, an electric-operated drain valve comprising an electric drain valve actuator and a drain valve mechanism controlled by the electric drain valve actuator for selectively controlling flow of control fluid through the drain passage, each valve mechanism comprising a fluid control element that is selectively positioned by the respective electric actuator along a respective axis that is parallel to the main longitudinal axis of the body, in which each fluid control element comprises a respective grooved valve spool, and in which a groove of the spool of the drain valve is positioned in axial registration with the drain passage when the electric drain valve actuator is not electrically energized, thereby causing the drain valve to be normally open.

10. A fuel injector as set forth in claim 9 in which a groove of the spool of the supply valve is positioned out of axial registration with the supply passage when the electric supply valve actuator is not electrically energized, thereby causing the supply valve to be normally closed.

11. A fuel injector as set forth in claim 10 in which the supply valve mechanism includes a return spring that positions the spool of the supply valve out of axial registration with the supply passage when the electric supply valve actuator is not electrically energized.

12. A fuel injector as set forth in claim 9 in which the drain valve mechanism includes a return spring that positions the groove of the spool of the drain valve to axial registration with the drain passage when the drain valve actuator is not electrically energized.

13. A fuel injector as set forth in claim 9 in which the piston comprises a head having an end surface exposed to the control chamber and a plunger having an end surface exposed to the injection chamber, and including a return spring acting on the piston in a direction along the main longitudinal axis of the body in a direction toward minimizing the volume of the control chamber.

14. A fuel injector for an internal combustion engine, the fuel injector comprising a body, a variable volume injection chamber within the body, a fuel port at which fuel enters the body, a fuel passage for conveying fuel from the fuel port to the injection chamber, a fuel injection port at which fuel from the injection chamber is injected from the body, a variable volume control chamber, a control fluid supply port at which control fluid enters the body, a control fluid drain port at which control fluid drains from the body, a piston operatively relating the injection chamber and the control chamber such that the volume of the injection chamber varies inversely with the volume of the control chamber, a supply passage for conveying control fluid from the supply port to the control chamber, a drain passage for conveying control fluid from the control chamber to the drain port, and an electric-operated valve mechanism for selectively controlling flow of control fluid through the supply passage independent of flow through the drain passage and for selectively controlling flow of control fluid through the drain passage independent of flow through the supply passage, in which the electric-operated valve mechanism comprises an electric-operated supply valve comprising an electric supply valve actuator and a supply valve mechanism controlled by the electric supply valve actuator for selectively controlling flow of control fluid through the supply passage, and an electric-operated drain valve comprising an electric drain valve actuator and a drain valve mechanism controlled by the electric drain valve actuator for selectively controlling flow of control fluid through the drain passage, and in which, when both valves are maximally open, the drain passage is relatively more restrictive to flow between the control chamber and the drain port than is the supply passage between the supply port and the control chamber.

15. A fuel injector for an internal combustion engine, the fuel injector comprising a body, a variable volume injection chamber within the body, a fuel port at which fuel enters the body, a fuel passage for conveying fuel from the fuel port to the injection chamber, a fuel injection port at which fuel from the injection chamber is injected from the body, a variable volume control chamber, a control fluid supply port at which control fluid enters the body, a control fluid drain port at which control fluid drains from the body, a piston operatively relating the injection chamber and the control chamber such that the volume of the injection chamber varies inversely with the volume of the control chamber, a supply passage for conveying control fluid from the supply port to the control chamber, a drain passage for conveying control fluid from the control chamber to the drain port, and an electric-operated valve mechanism for selectively controlling flow of control fluid through the supply passage independent of flow through the drain passage and for selectively controlling flow of control fluid through the drain passage independent of flow through the supply passage, in which the electric-operated valve mechanism comprises an electric-operated supply valve comprising an electric supply valve actuator and a supply valve mechanism controlled by the electric supply valve actuator for selectively controlling flow of control fluid through the supply passage, and an electric-operated drain valve comprising an electric drain valve actuator and a drain valve mechanism controlled by the electric drain valve actuator for selectively controlling flow of control fluid through the drain passage, and an operating system for operating the fuel injector, the operating system producing an injection by first causing the supply valve to open the supply passage and the drain valve to close the drain passage, then causing the supply valve to close the supply passage while the drain valve continues to close the drain passage, and then causing the supply valve to open the supply passage while the drain valve continues to close the drain passage.

16. A fuel injector for an internal combustion engine, the fuel injector comprising a body, a variable volume injection chamber within the body, a fuel port at which fuel enters the body, a fuel passage for conveying fuel from the fuel port to the injection chamber, a fuel injection port at which fuel from the injection chamber is injected from the body, a variable volume control chamber, a control fluid supply port at which control fluid enters the body, a control fluid drain port at which control fluid drains from the body, a piston operatively relating the injection chamber and the control chamber such that the volume of the injection chamber varies inversely with the volume of the control chamber, a supply passage for conveying control fluid from the supply port to the control chamber, a drain passage for conveying control fluid from the control chamber to the drain port, and an electric-operated valve mechanism for selectively controlling flow of control fluid through the supply passage independent of flow through the drain passage and for selectively controlling flow of control fluid through the drain passage independent of flow through the supply passage, in which the electric-operated valve mechanism comprises an electric-operated supply valve comprising an electric supply valve actuator and a supply valve mechanism controlled by the electric supply valve actuator for selectively controlling flow of control fluid through the supply passage, and an electric-operated drain valve comprising an electric drain valve actuator and a drain valve mechanism controlled by the electric drain valve actuator for selectively controlling flow of control fluid through the drain passage, and an operating system for operating the fuel injector, the operating system producing an injection by first causing the supply valve to open the supply passage and the drain valve to close the drain passage, then causing the supply valve to increasingly restrict, but not close, the supply passage while the drain valve continues to close the drain passage, and then causing the supply valve to increasingly open the supply passage while the drain valve continues to close the drain passage.

17. A fuel injector for an internal combustion engine, the fuel injector comprising a body, a variable volume injection chamber within the body, a fuel port at which fuel enters the body, a fuel passage for conveying fuel from the fuel port to the injection chamber, a fuel injection port at which fuel from the injection chamber is injected from the body, a variable volume control chamber, a control fluid supply port at which control fluid enters the body, a control fluid drain port at which control fluid drains from the body, a piston operatively relating the injection chamber and the control chamber such that the volume of the injection chamber varies inversely with the volume of the control chamber, a supply passage for conveying control fluid from the supply port to the control chamber, a drain passage for conveying control fluid from the control chamber to the drain port, and an electric-operated valve mechanism for selectively controlling flow of control fluid through the supply passage independent of flow through the drain passage and for selectively controlling flow of control fluid through the drain passage independent of flow through the supply passage, in which the electric-operated valve mechanism comprises an electric-operated supply valve comprising an electric supply valve actuator and a supply valve mechanism controlled by the electric supply valve actuator for selectively controlling flow of control fluid through the supply passage, and an electric-operated drain valve comprising an electric drain valve actuator and a drain valve mechanism controlled by the electric drain valve actuator for selectively controlling flow of control fluid through the drain passage, and an operating system for operating the fuel injector, the operating system terminating an injection by operating the supply valve to close the supply passage and thereafter operating the drain valve to open the drain passage.

* * * * *